US006267710B1

(12) United States Patent
Liu

(10) Patent No.: US 6,267,710 B1
(45) Date of Patent: Jul. 31, 2001

(54) EXERCISER STRUCTURE

(75) Inventor: Chien-Hsing Liu, NO 71, Fu-Hsing Street, Tai-Ping City, Taichung Hsien (TW)

(73) Assignees: Chien-Hsing Liu, Taichung Hsien; Alilife Industrial Co., Ltd., Taichung City, both of (TW)

( * ) Notice: Subject to any disclaimer, the term of this patent is extended or adjusted under 35 U.S.C. 154(b) by 0 days.

(21) Appl. No.: 09/548,003

(22) Filed: Apr. 12, 2000

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 5,860,893 * 5/1999 Watterson et al. ..... 482/54
5,899,834 * 8/1999 Dalebout et al. ..... 482/54
5,921,893 * 7/1999 Hurt ..... 482/54

* cited by examiner

*Primary Examiner*—Glenn E. Richman
(74) *Attorney, Agent, or Firm*—Rosenberg, Klein & Lee

(57) ABSTRACT

An exerciser structure includes a fixed unit and a movable unit. The movable unit includes a pair of ring sections. One of the ring sections is fixed with a torque generating portion. The fixed unit is disposed with a fixing board on which an inner guide wheel and several outer guide wheels are rotatably disposed. The inner and outer guide wheels tightly contact with the ring section, so that the ring section can be stably rotated. The exerciser structure can be easily folded with strength saved. In addition, the stress exerted onto the pivot section of the exerciser structure is evenly distributed. The exerciser structure can be alternatively folded by an electric folding measure as necessary.

3 Claims, 7 Drawing Sheets

EXERCISER STRUCTURE

BACKGROUND OF THE INVENTION

The present invention relates to an improved exerciser structure which includes ring sections and a torque generating means which enable a user to fold the exerciser structure with less strength. In addition, the stress exerted onto the pivot section of the exerciser structure is evenly distributed. The exerciser structure can be alternatively folded by an electric folding measure as necessary.

FIGS. 1 and 2 show a conventional running exerciser which includes a base seat 91, a rail 92 and a running belt assembly 93. The running belt assembly 93 includes a frame body 931, two rollers 932, a running belt 933, an auxiliary pneumatic cylinder 934, a motor 935 for driving the running belt 933 and a pivot shaft 936. After used, the running belt assembly 93 is turned from a first position P1 to a second position P2 for saving room.

The above running exerciser has a shortcoming, that is, the pivot shaft 936 suffers a concentrated stress so that the pivot shaft 936 is apt to be damaged. Furthermore, after a long period of use, the auxiliary pneumatic cylinder 934 tends to fail due to leakage of air. Also, the conventional running exerciser cannot be folded by electrical measure.

SUMMARY OF THE INVENTION

It is therefore a primary object of the present invention to provide an improved exerciser structure in which the stress exerted onto the pivot section of the exerciser structure is evenly distributed without concentration. Therefore, the using life of the exerciser structure is prolonged.

It is a further object of the present invention to provide the above improved exerciser structure in which a torque generating means is used instead of the conventional auxiliary pneumatic cylinder so as to eliminate the problem of leakage of air of the pneumatic cylinder.

It is a further object of the present invention to provide the above improved exerciser structure which can cooperate with an electrically folding measure as the torque generating measure so that the function of the exerciser can be easily advanced and the exerciser can be electrically folded.

According to the above objects, the exerciser structure of the present invention includes:

a fixed unit having a base section, a rail section upward extending from the base section and a control panel; and a movable unit having a frame body on which an exercising device is disposed.

The frame body of the movable unit further includes a pair of ring sections. One of the ring sections is fixed with a torque generating means. Each of the ring sections has an inner circumference and an outer circumference.

The base section of the fixed unit is disposed with a fixing board on which an inner guide wheel and multiple outer guide wheels are rotatably disposed. The inner guide wheel tightly contacts with the inner circumference of the ring section. The outer guide wheels tightly contact with the outer circumference of the ring section, whereby the ring section can rotate stably and the movable unit can rotate on the fixed unit between a substantially horizontal first position prior to folding and a substantially vertical second position after folded.

The present invention can be best understood through the following description and accompanying drawings wherein:

DETAILED DESCRIPTION OF THE PREFERRED EMBODIMENTS

Figure 2:
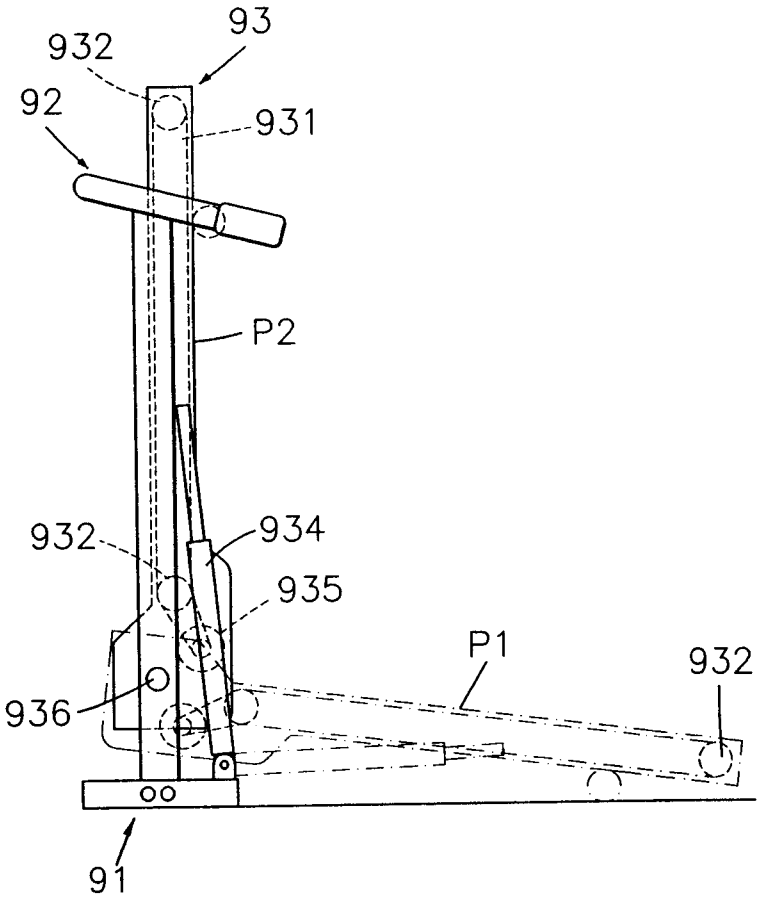
FIG. 2 (PRIOR ART)
FIG. 2 is a side view of the conventional running exerciser, showing the folding operation thereof.
Figure 1:
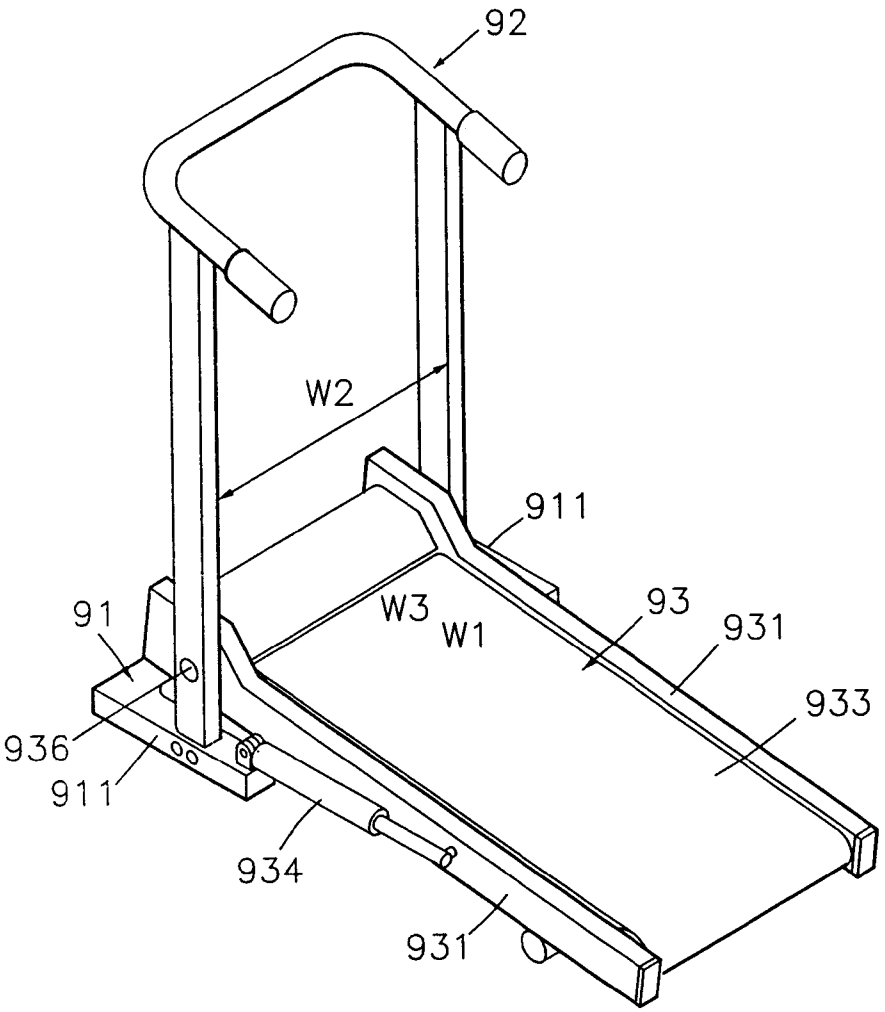
FIG. 1 (PRIOR ART)
FIG. 1 is a perspective view of a conventional running exerciser.
Figure 3:
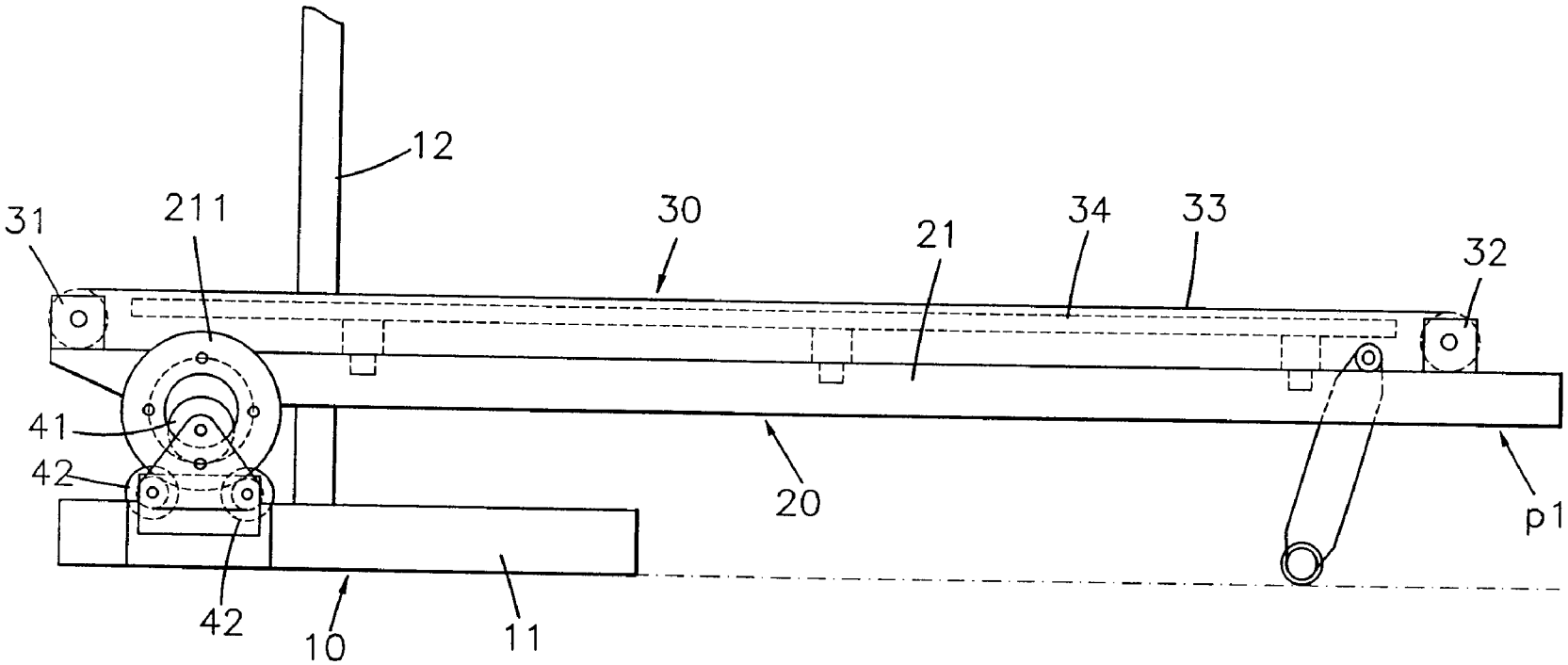
FIG. 3 is a side view of the present invention in a using state.
Figure 4:
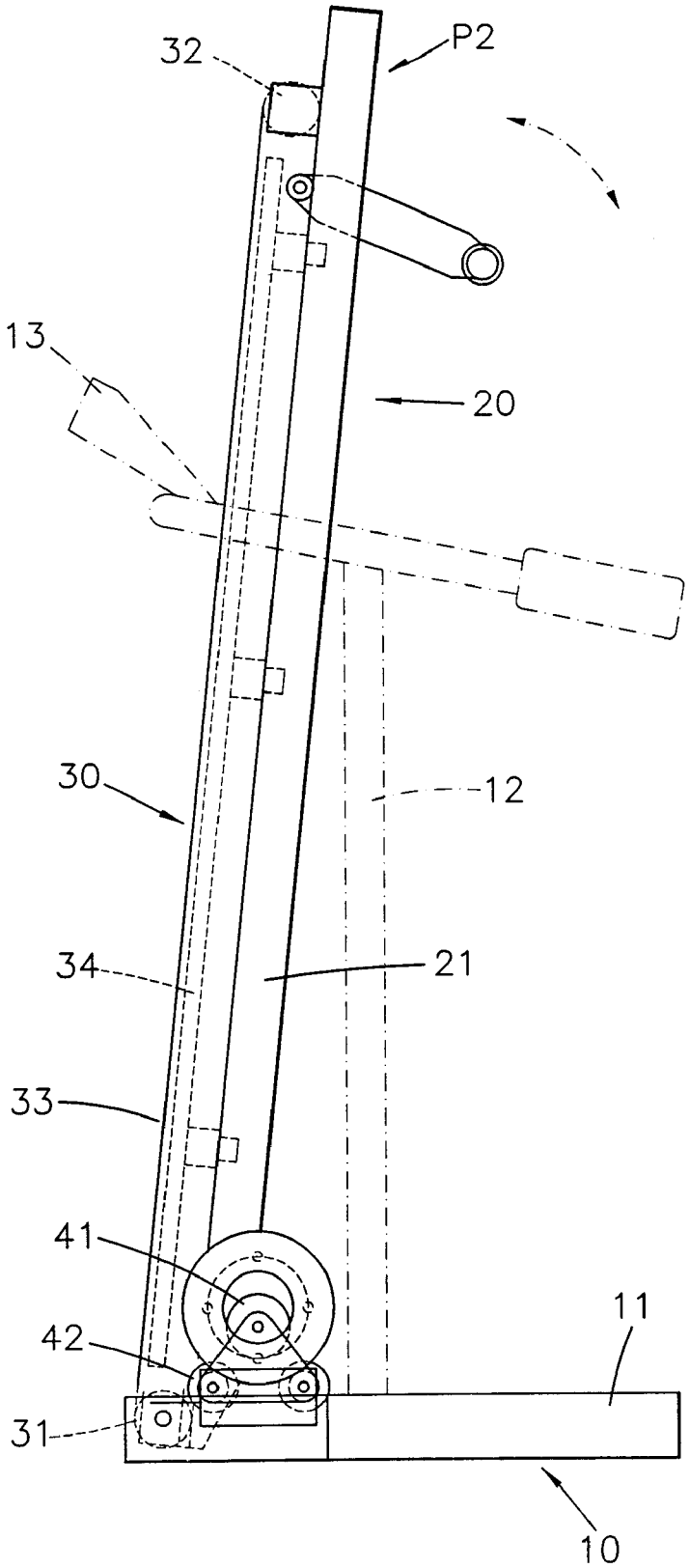
FIG. 4 is a side view of the present invention in a folded state.

Please refer to FIGS. 3 to 6. According to a first embodiment, the manually foldable exerciser structure of the present invention includes:

a fixed unit 10 having a base section 11, a rail section 12 upward extending from the base section 11 and a control panel 13; and a movable unit 20 having a frame body 21 on which an exercising device 30 is disposed. The exercising device 30 includes a front roller 31, a rear roller 32, a running belt 33 circularly wound on the front and rear rollers 31, 32 and a running board 34 positioned bib between the front and rear rollers 31, 32.

The frame body 21 further includes a pair of ring sections 211. One of the ring sections 211 is fixed with a torque generating means 50, 60. Each of the ring sections 211 has an inner circumference 211A and an outer circumference 211B.

The base section 11 of the fixed unit 10 is disposed with a fixing board 111 on which an inner guide wheel 41 and multiple outer guide wheels 42 are rotatably disposed. The inner guide wheel 41 tightly contacts with the inner circumference 211A of the ring section 211. The outer guide wheels 42 tightly contact with the outer circumference 211B of the ring section 211, whereby the ring section 211 can rotate stably. Accordingly, the movable unit 20 can rotate on the fixed unit 20 between a substantially horizontal first position P1 prior to folding and a substantially vertical second position P2 after folded.

In this embodiment, the torque generating means 50 has a disc member 51 coupled with the ring section 211. The disc member 51 has an extending support tube 52. The rear end of the support tube 52 is rotatably disposed on the base section 11 of the fixed unit 10. A prestressed torque spring 53 is wound around the support tube 52. One end of the torque spring 53 is fixed at the disc member 51, while the other end thereof is fixed on the base section 11.

When folding the exerciser, the prestressed torque spring 53 can offset the weight of the entire movable unit 20. Therefore, a user can use less strength to turn the entire movable unit 20 from the first position P1 to the second position P2. Reversely, the movable unit 20 can be placed down without quickly falling down to cause accident.

Figure 5:
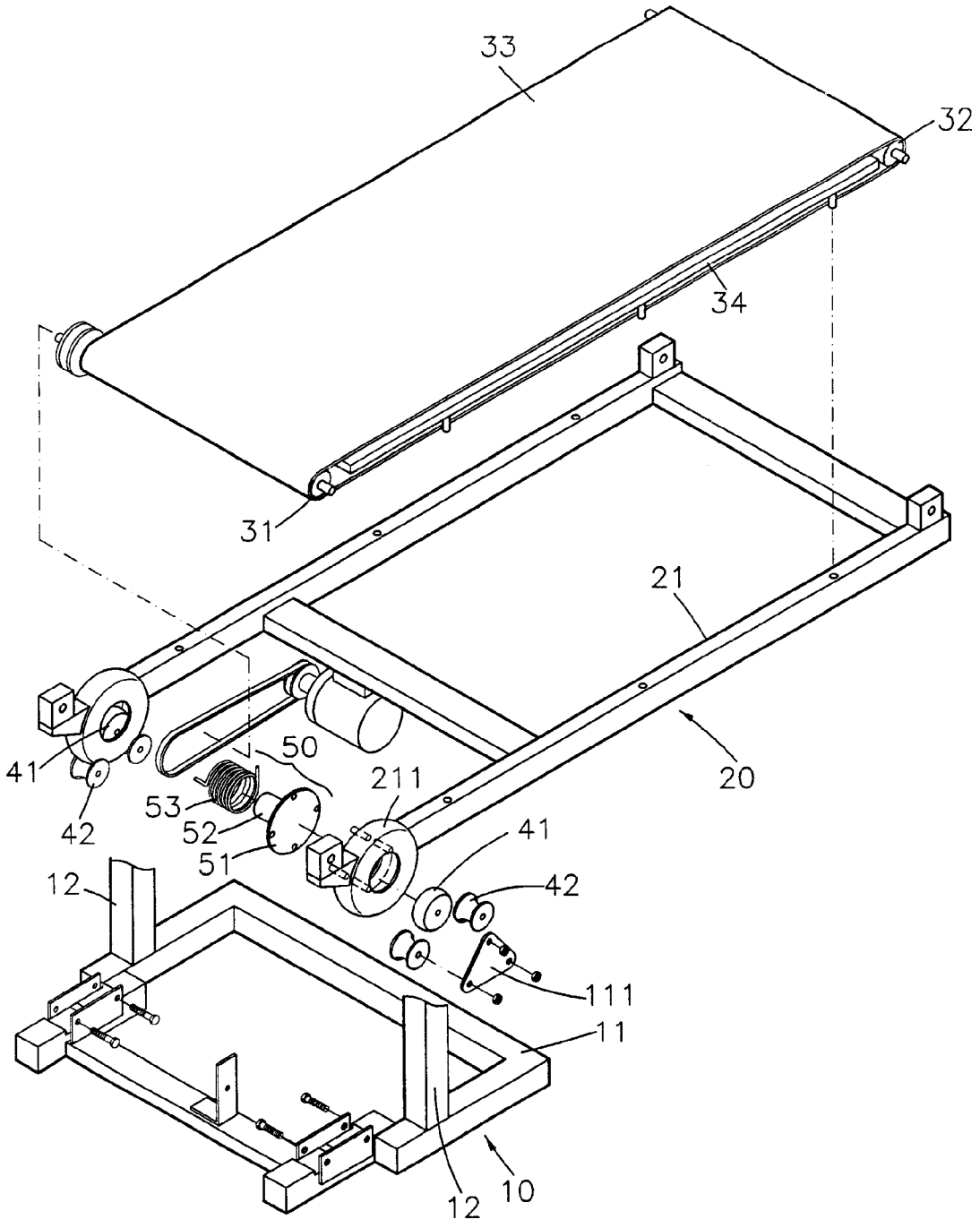
FIG. 5 is a perspective partially exploded view of a first embodiment of the present invention.
Figure 6:
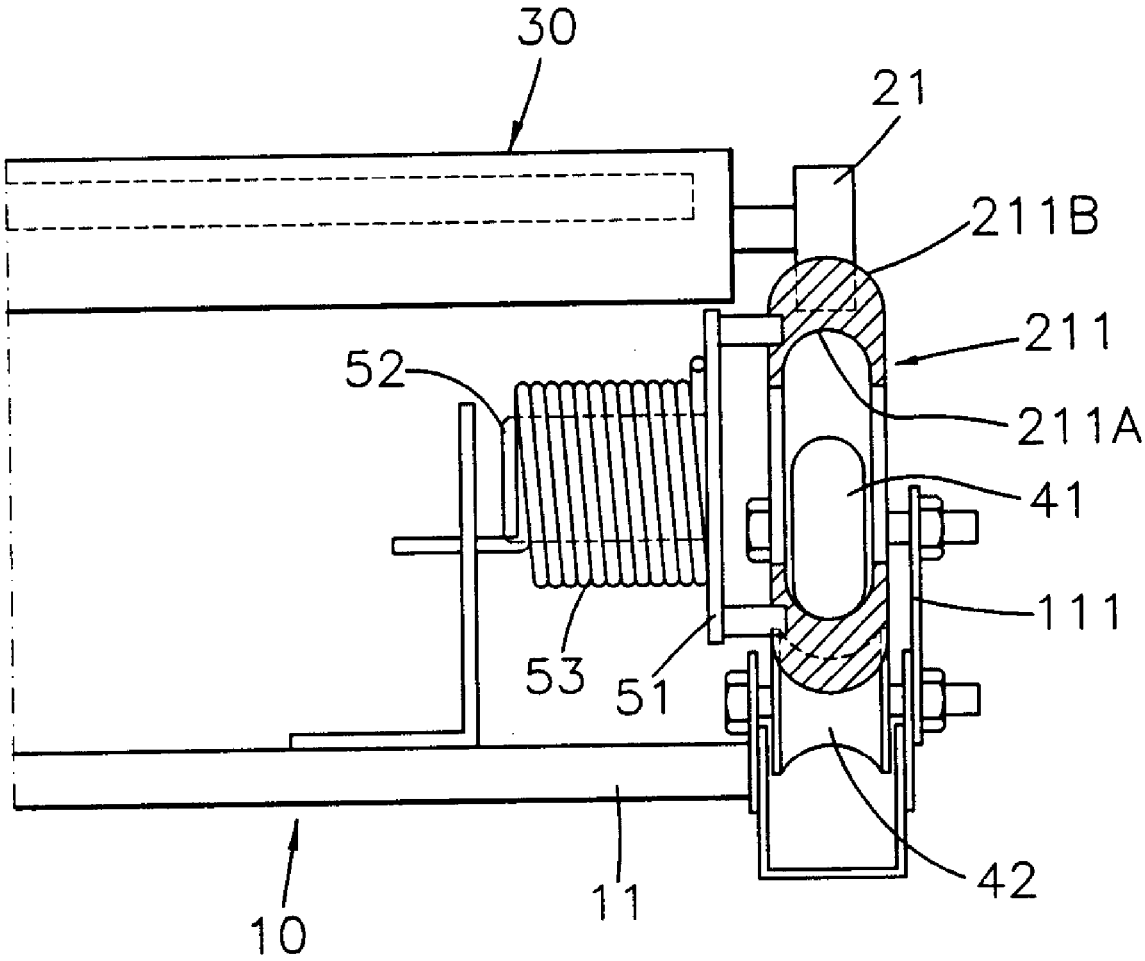
FIG. 6 is a sectional view of a part of the first embodiment of the present invention.
Figure 7:
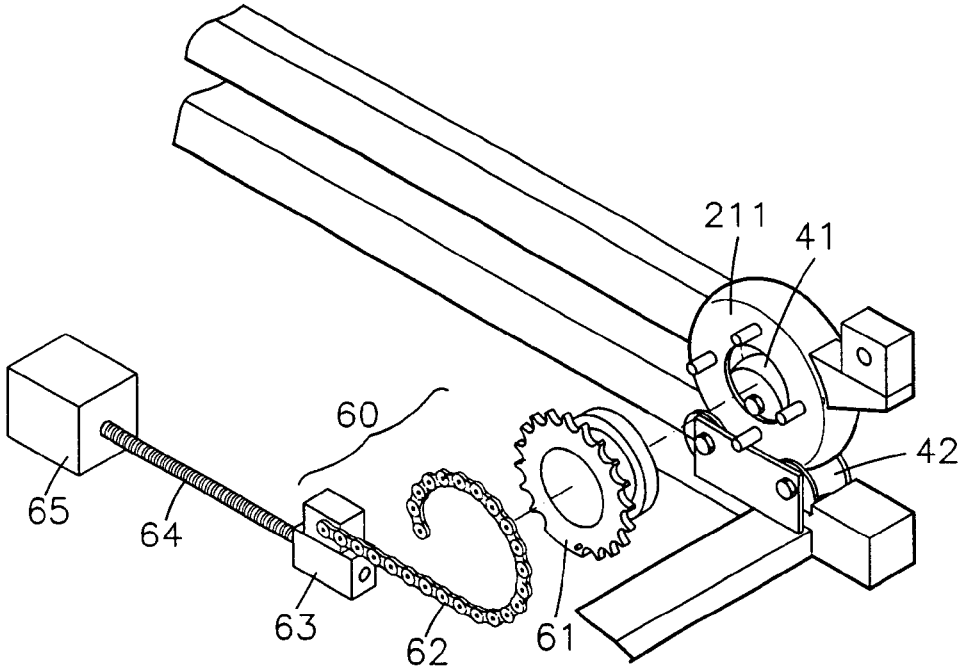
FIG. 7 is a perspective exploded view of a second embodiment of the present invention.
Figure 8:
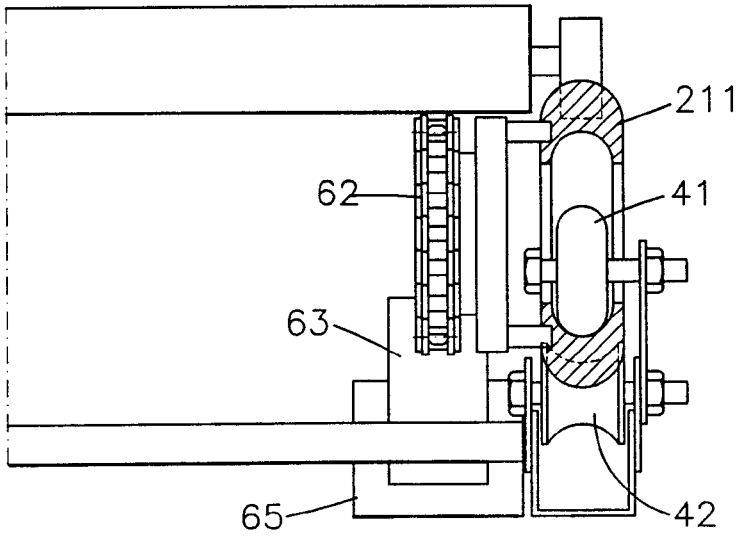
FIG. 8 is a sectional view of a part of the second embodiment of the present invention.
Figure 9:
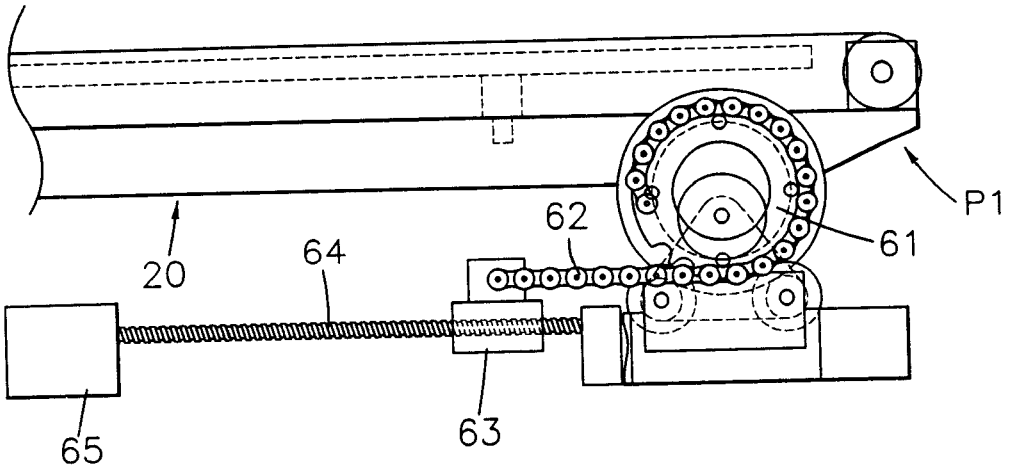
FIG. 9 is a side view of the second embodiment of the present invention before folded.
Figure 10:
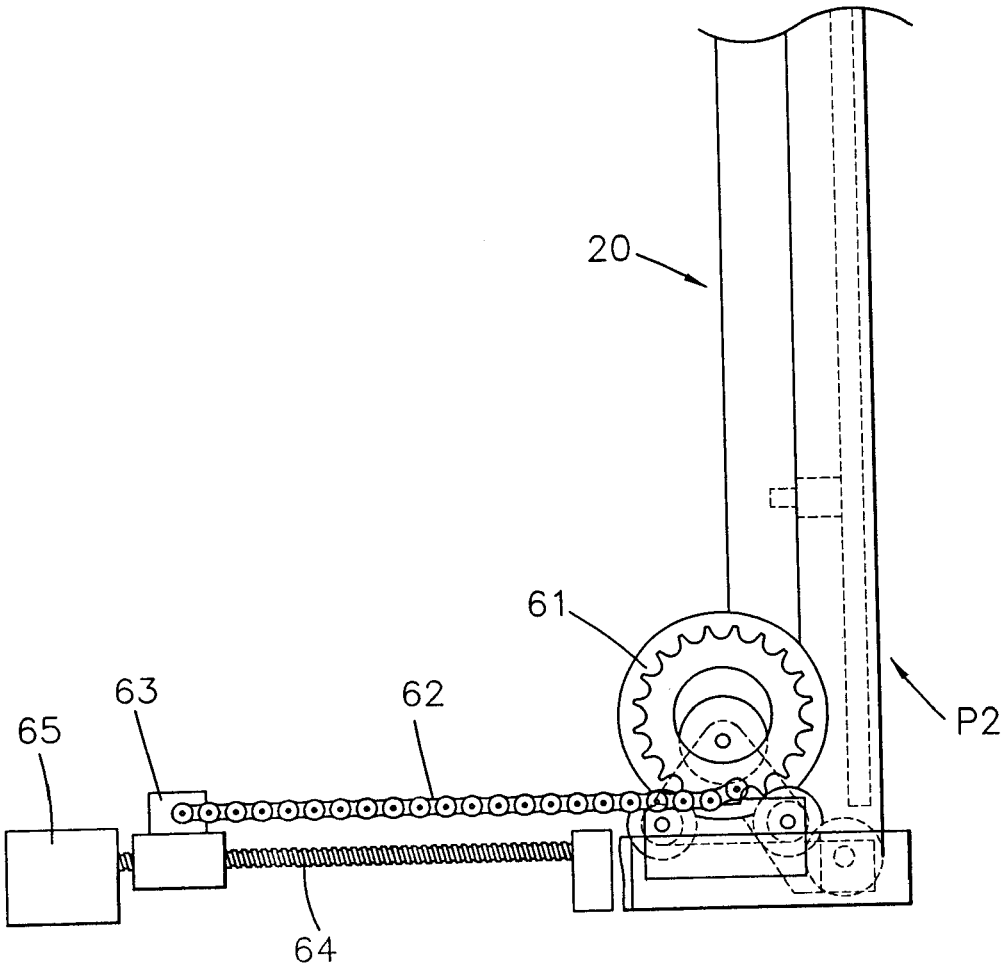
FIG. 10 is a side view of the second embodiment of the present invention after folded.

In addition, as shown in FIGS. 5 and 6, the ring section 211 has a hollow center and only the inner and outer circumferences 211A, 211B of the lowermost end of the ring section 211 are tightly clamped by the inner and outer guide wheels 41, 42 at three positions. Therefore, the weight of the entire movable unit 20 is distributed to the lowermost end of the ring section 211 and the inner and outer guide wheels 41, 42. In contrast, the single pivot shaft of the conventional device is subject to concentrated stress and tends to be damaged. Furthermore, the torque generating means of the present invention can be used instead of the conventional auxiliary pneumatic cylinder to eliminate the problem of leakage of air.

FIGS. 7 to 10 show a second embodiment of the present invention, which employs an electric measure for folding the exerciser. The basic structure of this embodiment is identical to that of the first embodiment. The only difference between the two embodiments resides in the torque generating means.

The torque generating means 60 of the second embodiment includes a sprocket 61, a chain 62, a movable block 63, a thread rod 64 and a driving device 65. The sprocket 61 is coupled with the ring section 211. A part of the chain 62 is engaged with the sprocket 61. One end of the chain 62 is fixed on the sprocket 61, while the other end thereof is fixed on the movable block 63. The movable block 63 is formed with a thread hole 631 in which the thread rod 64 is screwed. The driving device 65 serves to drive the thread rod 64 to rotate so as to move the movable block 63. Through the chain 62, the sprocket 61 is rotated. Accordingly, the ring section 211 and the entire movable unit 20 are rotated from the first position P1 to the second position P2 and vice versa.

Therefore, the manually folding measure of the present invention can be easily replaced by an electrically folding measure by means of changing the torque generating device. Accordingly, the second embodiment not only achieves the function of the first embodiment, but also is advantageous over the traditional auxiliary pneumatic cylinder.

The above embodiments are only used to illustrate the present invention, not intended to limit the scope thereof. Many modifications of the above embodiments can be made without departing from the spirit of the present invention. For example, the positions and numbers of the inner and outer guide wheels can be changed and the sprocket and chain can be replaced by a disc and a steel cord.

What is claimed is:

1. An exerciser structure comprising:

a fixed unit having a base section, a rail section extending upwardly from the base section and a control panel; and a movable unit having a frame body on which an exercising device is disposed, the frame body of the movable unit including a pair of ring sections, and torque generating means coupled to one of the ring, each of the ring sections having an inner circumference and an outer circumference; and the base section of the fixed unit including on each side thereof (a) a fixing board, (b) an inner guide wheel rotatably coupled to the fixing board, and (c) multiple outer guide wheels rotatably coupled to the fixing board, the inner guide wheel tightly contacting the inner circumference of a corresponding one of the ring sections, the outer guide wheels tightly contacting the outer circumference of the corresponding one of the ring sections, whereby the ring sections are stably rotatable and thereby the movable unit is rotatable relative to the fixed unit between a substantially horizontal position and a substantially vertical folded position.

2. An exerciser structure as claimed in claim 1, wherein the exercising device includes a front roller, a rear roller, a running belt rotatably wound on the front and rear rollers, and a running board positioned between the front and rear rollers, the torque generating means including a disc member coupled to the one ring section, the disc member having an extending support tube, a prestressed torque spring being wound around the support tube with one end of the torque spring being fixed to the disc member and an opposing end thereof being fixed to the base section.

3. An exerciser structure as claimed in claim 1, wherein the exercising device includes a front roller, a rear roller, a running belt rotatably wound on the front and rear rollers, and a running board positioned between the front and rear rollers, the torque generating means including a sprocket, a chain, a movable block, a threaded rod and a driving device drivingly coupled to the threaded rod for rotation thereof, the sprocket being coupled to the one ring section, one end of the chain being affixed to the sprocket and a portion of the chain adjacent the one end being engageable with the sprocket, an opposing end of the sprocket being fixed to the movable block, the movable block having a threaded hole formed therein for threaded engagement with the threaded rod to thereby displace the movable block responsive to rotation of the threaded rod.

* * * * *